US006149148A

United States Patent [19]

Zahn et al.

[11] Patent Number: 6,149,148

[45] Date of Patent: Nov. 21, 2000

[54] HURDLE OR RACK BOARD FOR SHEET-FED PRINTING MACHINES

[75] Inventors: Erich Zahn, Eppelheim; Rainer Klenk, St. Leon-Rot, both of Germany; Richard Mack, Kennesaw, Ga.

[73] Assignee: Heidelberger Druckmaschinen Aktiengesellschaft, Heidelberg, Germany

[21] Appl. No.: 09/351,607

[22] Filed: Jul. 12, 1999

[30] Foreign Application Priority Data

Jul. 11, 1998 [DE] Germany ..... 198 31 185

[51] Int. Cl.[7] ..... B65H 31/00

[52] U.S. Cl. ..... 271/207; 108/52.1; 108/133; 271/287

[58] Field of Search ..... 108/53.1, 55.1, 108/57.29, 52.1, 125, 131, 132, 133, 91; 271/145, 157, 287, 9.11, 207; 211/50, 55; 400/624

[56] References Cited

U.S. PATENT DOCUMENTS

| | | | |
|---|---|---|---|
| 2,047,389 | 7/1936 | Sinclair | 108/125 |
| 2,267,502 | 12/1941 | Lewis | 400/624 |
| 2,690,942 | 10/1954 | Marcus | 108/132 |
| 2,799,548 | 7/1957 | Arden | 108/125 |
| 3,719,157 | 3/1973 | Arcocha et al. | 108/57.29 |
| 3,857,343 | 12/1974 | Greenberg | 108/133 |
| 5,074,223 | 12/1991 | Remmers | 108/91 |
| 5,582,114 | 12/1996 | Feiner | 108/52.1 |
| 5,664,934 | 9/1997 | Schaede | 108/53.1 |

*Primary Examiner*—H. Grant Skaggs
*Attorney, Agent, or Firm*—Herbert L. Lerner; Laurence A. Greenberg; Werner H. Stemer

[57] ABSTRACT

A hurdle board assembly for separating sheet piles in a delivery of a sheet-fed printing machine includes a hurdle board. A plurality of spacer elements are connected to the hurdle board at locations in the vicinity of the border of one surface of the hurdle board. The spacer elements are respectively movable between a condition wherein they are retracted into the hurdle board and a condition wherein they extend vertically from the hurdle board. Respective prestressing devices are provided for prestressing the spacer elements, respectively, in a direction in the condition wherein the spacer elements, respectively, extend from the hurdle board. Respective locking devices are provided for securing the spacer elements, respectively, in the retracted condition. The locking devices are deactivatable from a side of the hurdle board so as to release the spacer elements.

8 Claims, 2 Drawing Sheets

HURDLE OR RACK BOARD FOR SHEET-FED PRINTING MACHINES

BACKGROUND OF THE INVENTION

Field of the Invention

The invention relates to a hurdle or rack board for separating sheet piles in a delivery of a sheet-fed printing machine. Hurdle boards are panels or pallets which, in the delivery of a sheet-fed printing machine, are positioned on a pile board and then above one another, with an interposition of spacer elements, respectively, in order to form a relatively low partial pile of sheets of paper or other printing materials, respectively, thereon. Such a hurdle operation is necessary if sheets in a relatively high pile were to stick together as a result of the weight of the pile, as can occur, for example, in the case of intensive ink application and/or thin printing materials. The spacer elements keep the hurdle boards spaced apart from one another a distance that is greater than the height of the individual partial piles, with the result that the pile pressure is limited, and blocking of sheets is prevented.

In the case of hurdle work or operation, the machine operator usually positions, for example, four spacer elements manually around the last-formed partial pile, on the pile board or on the uppermost of the hurdle boards which, for this purpose are somewhat larger than the maximum printable sheet format, and then places the next hurdle board in position, in which case, the operator must be careful not to move the spacer elements. These handling procedures are also necessary in the case of a delivery for non-stop operation, as is described, for example, in the published German Patent Document DE-A-4 344 361. In such a case, the introduction and positioning of the spacer elements is not merely laborious, but also, due to the continuing operation of the printing machine, very dangerous, in particular in the case of the rear or inner spacer elements, for which the operator has to reach far into the delivery.

SUMMARY OF THE INVENTION

It is accordingly an object of the invention to provide a hurdle board for sheet-fed printing machines which reduces the amount of energy expended for hurdle work or operation and the safety problems associated therewith.

With the foregoing and other objects in view, there is provided, in accordance with the invention, a hurdle board assembly for separating sheet piles in a delivery of a sheet-fed printing machine, comprising a hurdle board, a plurality of spacer elements connected to the hurdle board at locations in the vicinity of the border of one surface of the hurdle board, the spacer elements, respectively, being movable between a condition wherein they are retracted into the hurdle board and a condition wherein they extend vertically from the hurdle board, respective prestressing devices for prestressing the spacer elements, respectively, in a direction of the condition wherein the spacer elements, respectively, extend from the hurdle board, and respective locking devices for securing the spacer elements, respectively, in the retracted condition, the locking devices being deactivatable from a side of the hurdle board so as to release the spacer elements.

In accordance with another feature of the invention, the hurdle board is a rectangular panel having a surface area greater than a maximum sheet format, and the spacer elements, respectively, are disposed in the vicinity of respective corners of the hurdle board and outside the maximum sheet format.

In accordance with a further feature of the invention, a multiplicity of parallel, regularly spaced-apart grooves are formed in at least one of the two surfaces of the hurdle board.

In accordance with an added feature of the invention, the hurdle board assembly includes pushbuttons actuatable for deactivating the locking devices in order to release the spacer elements, the pushbuttons being located on side surfaces of the hurdle board.

In accordance with an additional feature of the invention, the side surfaces of the hurdle board are formed at predetermined locations with recesses having a register form.

In accordance with yet another feature of the invention, a surface of the hurdle board facing away from the spacer elements is formed so as to effect a formlocking or positive connection with extended spacer elements of an adjacent hurdle board. In this regard, it is noted that a formlocking connection is one which connects two elements together due to the shape of the elements themselves, as opposed to a forcelocking connection, which locks the elements together by force external to the elements.

In accordance with yet a further feature of the invention, each of the spacer elements is formed as an elongated rail rotatably mounted at one end thereof in an elongated groove formed in the hurdle board, the spacer elements, respectively, being swingable into the respective elongated grooves.

In accordance with a concomitant feature of the invention, the hurdle board has an overall height of approximately 1.5 to 2 cm when the spacer elements are in the retracted condition thereof.

Such a hurdle board with integrated spacer elements is stored and handled in the condition in which the spacer elements are retracted. When required, the machine operator lifts the hurdle board into the delivery and aligns it therein. Thereafter, the machine operator deactivates or unlocks the locking or arresting device for the spacer elements, for example, by actuating pushbuttons which are provided in suitable positions laterally on the hurdle board. The spacer elements then swing out or extend automatically and are automatically located in the correct positions. Because the position of the spacer elements relative to the hurdle board is fixed, all that the machine operator need do is to ensure the correct alignment of the hurdle board relative to the preceding hurdle boards.

The hurdle boards according to the invention can be used either with the spacer elements in the upward direction or with the spacer elements in the downward direction. In the former case, the spacer elements of a hurdle board on which a partial sheet pile is being formed are swung upwardly the instant the partial sheet pile has reached the permissible height, and the next hurdle board is placed in position. In the latter case, the spacer elements swing downwardly, and the hurdle board is deposited on the preceding hurdle board, on which a partial sheet pile has been formed.

With a delivery provided for non-stop operation, it is usually the case that, while the next rack board is being introduced, a movable rake formed of parallel bars retains the sheets arriving continuously from the printing units. In order for the intermediate sheet pile formed on the rake to be transferred to the hurdle board, the latter is formed with parallel grooves which have a greater cross section than the bars and into which the bars can penetrate, whereupon the rake can be pulled out from underneath the intermediate sheet pile.

Such grooves for non-stop operation may also be provided in a hurdle board according to the invention. If relatively low hurdle boards with a thickness of approximately 1.5 to 2 cm are used, the grooves are formed either on the surface with the spacer elements or on the opposite surface of the hurdle board, depending upon the orientation in which the rack boards are to be used. In the case of relatively high hurdle boards, it is also possible for grooves to be formed on both surfaces, with the result that these hurdle boards can be used on both sides.

It is not just that the hurdle boards according to the invention are very simple and safe to use, but that they also make it possible wholly or partially to automate hurdle operation, which it has heretofore only been able to be executed manually. If pushbuttons or similar actuating elements which release the locking devices upon actuation are provided on side surfaces of the hurdle board, this not only facilitates manual operation, but also means that the pushbuttons can easily be actuated with the aid of, for example, electromechanical or pneumatic actuators which are provided at appropriate locations in the delivery, in order to release the spacer elements on a machine-control command.

Within the context of yet further-advancing automation, it is possible for the hurdle boards to be fed mechanically to the delivery. In order to facilitate automatic handling of the hurdle board, it is possible to provide accurately fitting recesses at predetermined locations in the side surfaces of the hurdle board, it being possible for suitable gripping elements of an automatic conveying arrangement to engage in a positively locking or formlocking manner in the recesses.

In the preferred embodiment, the hurdle board is a rectangular panel having a surface area that is greater than the maximum sheet format, one spacer element, respectively, being located in the vicinity of each corner of the hurdle or rack board and outside the maximum sheet format. If that surface of the hurdle board that is directed away from the spacer elements is formed for a positively locking or formlocking connection to the extended spacer elements of an adjacent hurdle board, the accurately fitting or in-register alignment of the hurdle board over the preceding hurdle board is facilitated.

The spacer elements are preferably elongated rails which, at one end, respectively, are mounted rotatably in an elongated groove formed in the hurdle board, it being possible for the spacer element to be swung into the groove. Movable struts and, if appropriate, additional locking or arresting devices may be provided in order to fix the spacer elements in the swung-out or extended condition.

Other features which are considered as characteristic for the invention are set forth in the appended claims.

Although the invention is illustrated and described herein as embodied in a hurdle or rack board for sheet-fed printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

The hurdle board assemblies shown in FIGS. 1*a* to 1*f* have hurdle boards 2 formed as rectangular panels or pallets having a width and a length which are greater than the width and the length, respectively, of the largest sheets which can be printed in a printing machine having a delivery in which the hurdle boards are used.

Figure 1A:
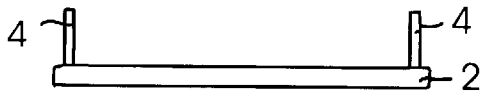
FIGS. 1*a* to 1*f* are diagrammatic elevational views of diverse forms of hurdle boards with integrated foldable spacer elements.

The hurdle board 2 is provided with four spacer elements 4, one at each corner, which can be swung inwardly or retracted, and swung outwardly or extended, the spacer elements 4 in FIG. 1*a* having been swung out vertically upwardly. The spacer elements 4 are located on the top side of the hurdle board 2, outside the surface area corresponding to a maximum printable sheet format. A sheet pile can be formed on the top side of the hurdle board 2 up to a maximum height, which is smaller than the length of the spacer elements 4. Thereafter, a further hurdle board 2, of which the spacer elements 4 are swung out upwardly, is placed in position thereon, and so forth.

Figure 1B:
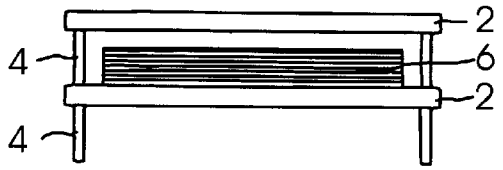

It is alternatively possible for the hurdle board 2 to be used in reversed position, with the spacer elements 4 directed downwardly, as shown in FIG. 1*b*. FIG. 1*b* also shows a further hurdle board 2 that has been positioned on top, as well as a sheet pile 6 between the hurdle boards 2.

Figure 1C:
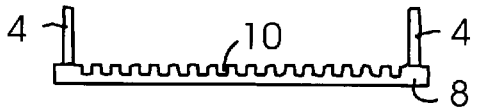

FIG. 1*c* shows a hurdle board 8 that is suitable for a So-called non-stop delivery. Formed in the top side of the hurdle board 8 are a multiplicity of equally spaced-apart parallel grooves 10, in which a non-illustrated rake can engage in order to permit the pile board of the delivery to be lowered and to introduce a new hurdle board 8, while the continuously fed sheets are stored in the interim by the rake. The spacer elements 4 of the hurdle board 8 extend upwardly, i.e., they are located on the same side of the hurdle 8 as the grooves 10.

Figure 1D:
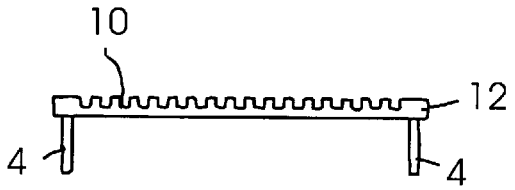

The hurdle board 12 shown in FIG. 1*d* differs from the hurdle board 8 in FIG. 1*c* merely by the fact that the spacer elements 4 of the hurdle board 12 extend downwardly, i.e., they are located on that side of the hurdle board 8 that is opposite from the grooves 10. Such hurdle boards 12 are stacked as is shown in FIG. 1*b*.

Figure 1E:
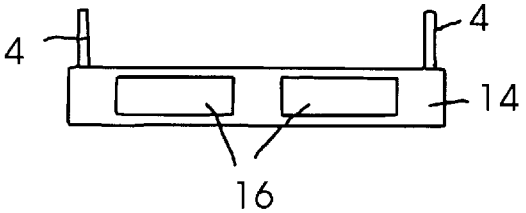
Figure 1F:
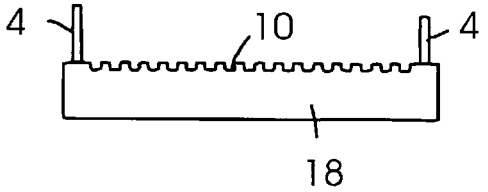

While the hurdle boards 2, 8 and 12 shown in FIGS. 1*a* to 1*d* are thin enough and low enough, respectively, for the bending or sagging that occurs during loading still to be acceptable in the normal case, use is sometimes also made of higher hurdle boards, such as are shown in FIGS. 1*e* and 1*f*. The hurdle board 14 in FIG. 1*e* is similar to the hurdle board 2 of FIG. 1*a*, but it is considerably thicker and higher, respectively. In order to limit the weight, the hurdle board 14, rather than being solid, is formed with diagrammatically represented cavities 16. Except for its thickness, the hurdle board 18 of FIG. 1*f* corresponds to the hurdle board 12 of FIG. 1*d*.

Figure 2A:
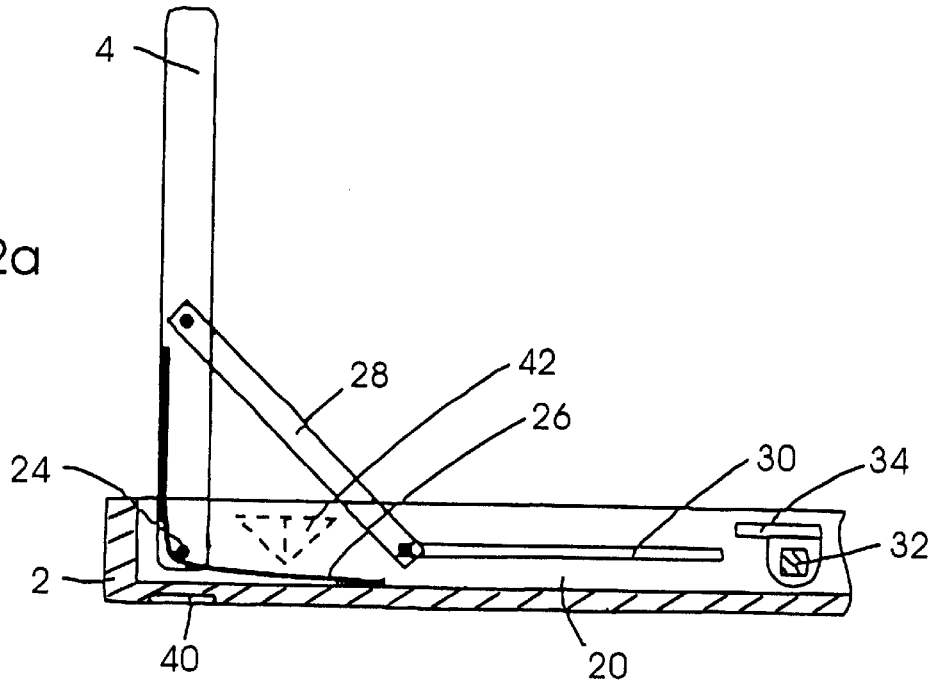
FIGS. 2*a* and 2*b* are side elevational views of a foldable spacer element in a hurdle board, shown in extended and retracted conditions, respectively.
Figure 2B:
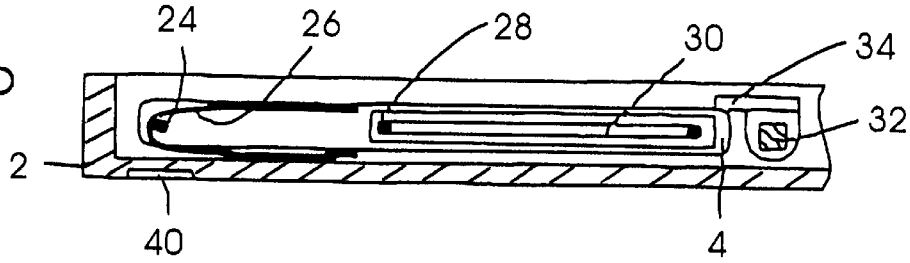
Figure 2C:
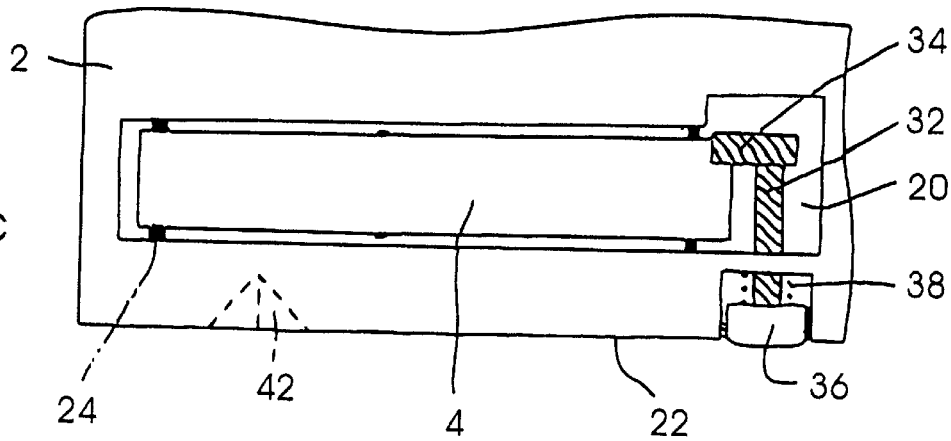
FIG. 2*c* is a top plan view of FIG. 2*b*.

FIGS. 2*a* and 2*b* are cross-sectional views of a hurdle board 2, as in FIG. 1*a*, in the region of a spacer element 4 which, in FIG. 2*a*, is in the swung-out or extended condition, while FIG. 2*b* shows the spacer element 4 in the swung-in or retracted condition. FIG. 2*c* is a plan view of the hurdle board 2 in the condition of FIG. 2*b*.

In the vicinity of each corner, the hurdle board 2 is formed with an elongated recess or groove 20 in the top side thereof, as viewed in FIG. 2*a*. The groove 20 extends along a side wall 22 (note FIG. 2*c*) of the hurdle board 2. The groove 20 is somewhat longer and has a somewhat greater cross section than the spacer element 4 which, in this embodiment, is an elongated rail of U-shaped cross section. Thus, the entire spacer element 4 can be received in the groove 20.

At one end, the spacer element 4 is swivellably mounted on a pin 24 that runs transversely through the groove 20 at one end of the latter. An elongated leaf spring 26, which is supported on the base of the groove 20, extends behind the pin 24 and into the spacer element 4, with the result that the spring 26 prestresses the spacer element 4 into the swung-out or extended condition thereof shown in FIG. 2*a*. In this swung-out or extended condition, the spacer element 4 is retained in its vertical position by a strut 28. At one end, the strut 28 is connected swivellably to the spacer element 4. At its other end, the strut 28 is mounted swivellably and is displaceable in the longitudinal direction in slots or elongated notches 30 formed in the side walls of the groove 20.

If the spacer element 4 is swung into the condition thereof shown in FIGS. 2*b* or 2*c*, counter to the action of the leaf spring 26, the strut 28 is displaced until it is received in its entirety in the interior of the spacer element 4. In this swung-in or retracted condition, the outer end of the spacer element 4 is secured by an arresting element having an axially movable shank 32 that passes through the side wall 22 and, in the interior, carries a catch 34 that engages behind the spacer element 4. Fastened at the outer end of the shank 32 is a pushbutton 36 (FIG. 2*c*), part of which is received in an opening formed in the side wall 22. A helical spring 38 prestresses the pushbutton 36 outwardly. When manual or mechanical pressure is exerted upon the pushbutton 36, the catch 34 releases the spacer element 4, so that the latter snaps upwardly into the condition shown in FIG. 2*a*.

In order to facilitate the locking of the spacer element 4 as it swings inwardly or retracts, it is possible for the catch 34 and the corresponding mating surface at the outer end of the spacer element 4 to carry non-illustrated sloping ramp surfaces which can slide on one another as the shank 32 is displaced axially.

If the stressing of the leaf spring 26 is insufficient for retaining the swung-out or extended spacer element 4 reliably in the vertical condition thereof, additional arresting devices may be provided for this purpose. For example, the slot or notch 30 may be formed so that the spacer element 4 is retained in a self-locking manner in the swung-out or extended condition, or the arresting element which, in the exemplary embodiment, has the shank 32, the catch 34 and the pushbutton 36, is constructed and disposed in some other manner, so that it also arrests the swung-out or extended spacer element 4.

In the region of the bearing location of the spacer element 4 in the hurdle board 2, a recess 40 is formed on the underside of the hurdle board 2, the outer end of a swung-out or extended spacer element 4 of a further hurdle board 2 fitting into the recess. This prevents lateral slippage of the hurdle boards 2 which are stacked above one another.

In the vicinity of each corner of the rack board 2, a recess 42 having a tetrahedral shape, for example, is formed in the side wall 22. The recesses 42 make it possible for the hurdle board 2 to be gripped in a positive or formlocking and accurately fitting or in-register manner by any type of gripping elements of an automatic conveying arrangement. In this regard, it is noted that a formlocking connection is one which connects two elements together due to the shape of the elements themselves, as opposed to a forcelocking connection, which locks the elements together by force external to the elements.

Instead of integral or one-piece spacer elements 4, it is also possible to use multipartite, length-adjustable spacer elements with which the pile height of the hurdle boards 2 can be adapted to the respective conditions.

When the hurdle board is of suitable thickness, rather than using swingable or foldable spacer elements, it is also possible to use spacer elements which can be extended telescopically out of the hurdle board.

We claim:

1. A hurdle board assembly for separating sheet piles in a delivery of a sheet-fed printing machine, comprising a hurdle board, a plurality of spacer elements connected to said hurdle board at locations in the vicinity of the border of one surface of the hurdle board, said spacer elements, respectively, being movable between a condition wherein they are retracted into the hurdle board and a condition wherein they extend vertically from the hurdle board, respective prestressing devices for prestressing said spacer elements, respectively, in a direction in the condition wherein said spacer elements, respectively, extend from said hurdle board, and respective locking devices for securing said spacer elements, respectively, in said retracted condition, said locking devices being deactivatable from a side of said hurdle board so as to release said spacer elements.

2. The hurdle board assembly according to claim 1, wherein said hurdle board is a rectangular panel having a surface area greater than a maximum sheet format, and said spacer elements, respectively, are disposed in the vicinity of respective corners of said hurdle board and outside the maximum sheet format.

3. The hurdle board assembly according to claim 1, wherein a multiplicity of parallel, regularly spaced-apart grooves are formed in at least one of the two surfaces of said hurdle board.

4. The hurdle board assembly according to claim 1, including pushbuttons actuatable for deactivating said locking devices in order to release said spacer elements, said pushbuttons being located on side surfaces of said hurdle board.

5. The hurdle board assembly according to claim 4, wherein said side surfaces of said hurdle board are formed at predetermined locations with recesses having a register form.

6. The hurdle board assembly according to claim 1, wherein a surface of said hurdle board facing away from said spacer elements is formed so as to effect a formlocking or positive connection with extended spacer elements of an adjacent hurdle board.

7. The hurdle board assembly according to claim 1, wherein each of said spacer elements is formed as an elongated rail rotatably mounted at one end thereof in an elongated groove formed in said hurdle board, said spacer elements, respectively, being swingable into the respective elongated grooves.

8. The hurdle board assembly according to claim 1, wherein said hurdle board has an overall height of approximately 1.5 to 2 cm when said spacer elements are in said retracted condition.

* * * * *